United States Patent [19]

Furukawa et al.

[11] 4,394,186

[45] * Jul. 19, 1983

[54] METHOD FOR PRODUCING A DUAL-PHASE STEEL SHEET HAVING EXCELLENT FORMABILITY, HIGH ARTIFICIAL-AGING HARDENABILITY AFTER FORMING, HIGH STRENGTH, LOW YIELD RATIO, AND HIGH DUCTILITY

[75] Inventors: Takashi Furukawa, Machida; Kazuo Koyama, Kimitsu, both of Japan

[73] Assignee: Nippon Steel Corporation, Tokyo, Japan

[ * ] Notice: The portion of the term of this patent subsequent to Aug. 25, 1998, has been disclaimed.

[21] Appl. No.: 213,175

[22] Filed: Dec. 4, 1980

[30] Foreign Application Priority Data

Dec. 15, 1979 [JP] Japan ..... 54-163277

[51] Int. Cl.[3] ..... C21D 8/02

[52] U.S. Cl. ..... 148/12 F; 148/12.4

[58] Field of Search ..... 148/2, 12 C, 12 D, 12 F, 148/12.4, 134

[56] References Cited

U.S. PATENT DOCUMENTS

| | | | |
|---|---|---|---|
| 3,951,696 | 4/1976 | Gondo et al. | 148/12 R |
| 4,062,700 | 12/1977 | Hayami et al. | 148/12.3 |
| 4,113,517 | 9/1978 | Nakaoka et al. | 148/2 |
| 4,159,218 | 6/1979 | Chatfield et al. | 148/12.4 |
| 4,285,741 | 8/1981 | Furukawa et al. | 148/12 D |

FOREIGN PATENT DOCUMENTS 1419704 12/1975 United Kingdom .

*Primary Examiner*—Peter K. Skiff
*Attorney, Agent, or Firm*—Kenyon & Kenyon

[57] ABSTRACT

A high-strength cold-rolled steel sheet with dual-phase structure, recently developed by the Japanese steel producers have a low yield ratio of approximately 0.6 or lower, is free of the yield-point elongation and is of excellent press-formability. One of the production methods of this steel is a continuous annealing at a temperature range of two-phase structure of ferrite ($\alpha$)+austenite ($\gamma$). In order to improve the formability, the artificial-aging hardenability after forming, yield ratio and ductility over those of the known dual-phase steel, the present invention provides a method for producing a dual-phase steel, which comprise a step of cooling from the annealing temperature to a temperature not higher than 200° C. at an average cooling rate ($R_1$) in the range of 1° C./second $\leqq R_1 \leqq$ 30° C./second over the primary cooling stage from the annealing temperature down to an intermediate temperature (T) in the range of 420° C. $\leqq T \leqq$ 700° C., and at an average cooling rate ($R_2$) in the range of 100° C./second $\leqq R_2 \leqq$ 300° C./second over the secondary cooling stage from the intermediate temperature (T) down to the temperature not higher than 200° C.

7 Claims, 6 Drawing Figures

| | YIELD STRENGTH kg/mm² | TENSILE STRENGTH kg/mm² | HOMOGENEOUS ELONGATION % | TOTAL ELONGATION % | n VALUE | YIELD STRENGTH / TENSILE STRENGTH |
|---|---|---|---|---|---|---|
| Ⓐ | 29.6 | 62.6 | 21.0 | 31.5 | 0.30 | 0.47 |
| Ⓑ | 45.5 | 60.0 | 17.5 | 25.0 | 0.21 | 0.76 |

| | YIELD STRENGTH kg/mm² | TENSILE STRENGTH kg/mm² | HOMOGENEOUS ELONGATION % | TOTAL ELONGATION % | n VALUE | YIELD STRENGTH / TENSILE STRENGTH |
|---|---|---|---|---|---|---|
| Ⓐ | 29.6 | 62.6 | 21.0 | 31.5 | 0.30 | 0.47 |
| Ⓑ | 45.5 | 60.0 | 17.5 | 25.0 | 0.21 | 0.76 |

METHOD FOR PRODUCING A DUAL-PHASE STEEL SHEET HAVING EXCELLENT FORMABILITY, HIGH ARTIFICIAL-AGING HARDENABILITY AFTER FORMING, HIGH STRENGTH, LOW YIELD RATIO, AND HIGH DUCTILITY

The present invention relates to a method for producing a cold-rolled or hot-rolled steel sheet with dual-phase structure, and more particularly the present invention relates to a method for producing such steel having excellent formability, high artificial-aging hardenability after forming, high strength, low yield ratio and high ductility.

The term "dual phase" used herein designates that the major constituent phases of steel are a ferrite phase and at least one rapidly-cooled transformed phase selected from the group consisting of a martensite phase, a bainite phase and a retained austenite phase. The term "artificial-aging hardenability" used herein designates an increase in the yield strength of a preliminarily work-strained steel sheet due to a later heating at a temperature from 170° to 200° C. The term "low yield ratio" designates not more than approximately 0.6 of the ratio, i.e. yield strength/tensile strength.

Recently, in the automotive industry, endeavours have been concentrated to reduce the weight of vehicles mainly to attain the reduction of fuel consumption. A high-strength steel sheet is indispensable for ensuring the satisfactorily high strength of a car body even by using a thin steel sheet adapted to the weight reduction of vehicles. Conventional high-strength steel sheets usually have a too high yield ratio to prevent springback during the press forming and too low work-hardening exponent, i.e. the n value, so that local strain is concentrated, that is necking is generated in the steel sheets, which noticeably leads to the generation of cracks. Accordingly, it has been difficult to widely use high-strength steel sheets for the vehicles in spite of the recognized necessity to use them. A high-strength cold-rolled steel sheet with dual phase structure, known from U.S. Pat. No. 3,951,696, is developed by the present applicant, so that the yield ratio, i.e. the yield strength-/tensile strength, is approximately 0.6 or lower, is free of the yield point elongation and is of excellent press-formability.

The stress-strain relationship of the steel of U.S. Pat. No. 3,951,696 and the conventional high-strength steel will be understood from FIG. 1, in which the symbols A and B indicate the latter and former steels, respectively. The following differences between steels A and B in the characteristic of press forming will be ascribable to the stress-strain relationship. First, since the yield ratio of steel A is lower than that of steel B, the springback tendency of steel A is lower than in steel B. Second, since the work-hardening exponent, i.e. the n value, and elongation of steel A are larger than those of steel B, cracking is less liable to occur in the former steel than in the latter steel. Third, the yield strength is enhanced even by a low level of strain in steel A, which provides the steel sheet with an extremely advantageous property in the light of the press forming as compared with steel B. Fourth, the yield ratio of steel A is lower than 0.6 which is recently preferred by the users of steel sheets for automobile parts. It is therefore expected that such a steel sheet as that disclosed in U.S. Pat. No. 3,951,696 is widely used in the automotive industry.

The present applicant has also proposed methods for producing the dual-phase steel in the following U.S. Patents. In U.S. Pat. No. 3,951,696, a Si-Mn steel containing approximately 1% silicon and approximately 1.5% manganese is continuously annealed at a temperature range of two-phase structure of ferrite ($\alpha$)+austenite ($\gamma$). This temperature range is hereinafter referred to as the alpha-gamma temperature range for the sake of brevity. In U.S. Pat. No. 4,062,700, a steel containing from 0.1 to 0.15% carbon and approximately 1.5% manganese is hot-rolled, in such a manner that the finishing temperature is in the alpha-gamma temperature range, and is then continuously annealed at the alpha-gamma temperature range. By the methods of U.S. Pat. Nos. 3,951,696 and 4,062,700 the hardenability of the austenite ($\gamma$) phase formed in the alpha-gamma temperature range is enhanced, and subsequently the austenite ($\gamma$) phase is transformed into the rapidly-cooled transformed phase by cooling, so as to obtain the dual phase. The cooling rate from the annealing temperature down to 500° C. is from 0.5 to 30° C./sec and in U.S. Pat. No. 3,951,696 and the cooling rate from the annealing temperature is not larger than about 10,000° C./minute, i.e. about 167° C./second, in U.S. Pat. No. 4,062,700. The cooling patterns, namely the cooling temperature-time diagrams, of these prior patents are based on the premise that monotonous cooling be conducted after the annealing, because no intention to artificially change the cooling rate during the cooling stage is recognized in these patents. Furthermore, the methods of these prior patents are pertinent to produce the high-strength dual-phase steel sheets having a tensile strength exceeding approximately 60 kg/mm$^2$. However, it is difficult to produce by these methods, the dual-phase steel sheets having a tensile strength of from 40 to 50 kg/mm$^2$. In this regard, in the automotive industry the dual-phase steel sheets having a tensile strength of from 40 to 50 kg/mm$^2$ are preferred rather than those steel sheets with tensile strength exceeding 60 kg/mm$^2$, because the former steel sheets can be widely used for automobile parts. Simultaneously, high artificial-aging hardenability after forming is preferred, because due to such hardenability, the yield strength of the formed articles can be remarkably enhanced by heating to a temperature of approximately 170° to 200° C. over a period of a few minutes to a few hours. A paint-baking apparatus can be used for the heating for enhancing the yield strength.

It is an object of the present invention to provide a method for producing a dual-phase steel, wherein the cooling rate is varied during the cooling process after the continuous annealing at the alpha-gamma temperature range, thereby improving the material properties over the prior art. The method of the present invention having a cooling pattern or curve adjusted to achieve the above-mentioned improvement must be capable of producing a dual-phase steel having the tensile strength of from 40 to 50 kg/mm$^2$ and yield ratio of less than 0.6 and also of improving the material properties of a dual-phase steel having tensile strength of 60 kg/mm$^2$ or higher.

The present invention will be explained in detail in reference to FIGS. 2 through 6.

Figure 3:
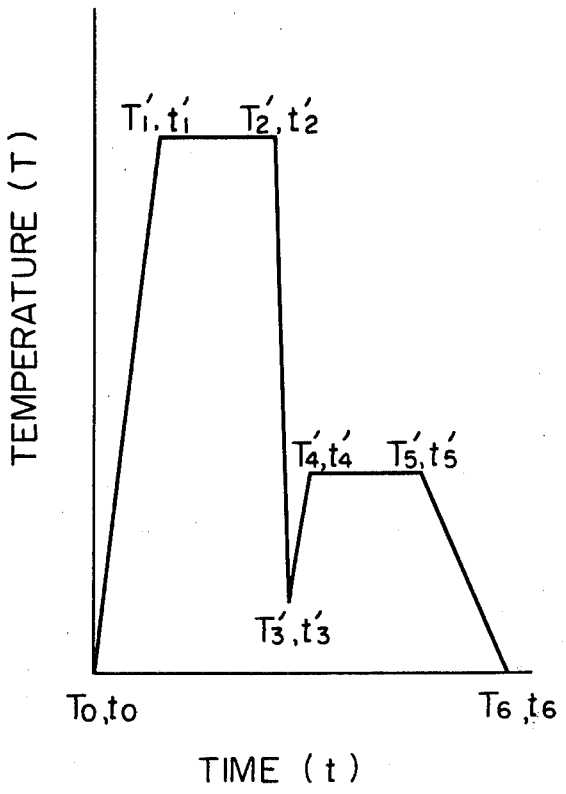

FIG. 3 illustrates a continuous annealing heat-cycle disclosed in B. Pat. No. 1,419,704.

Figure 4:
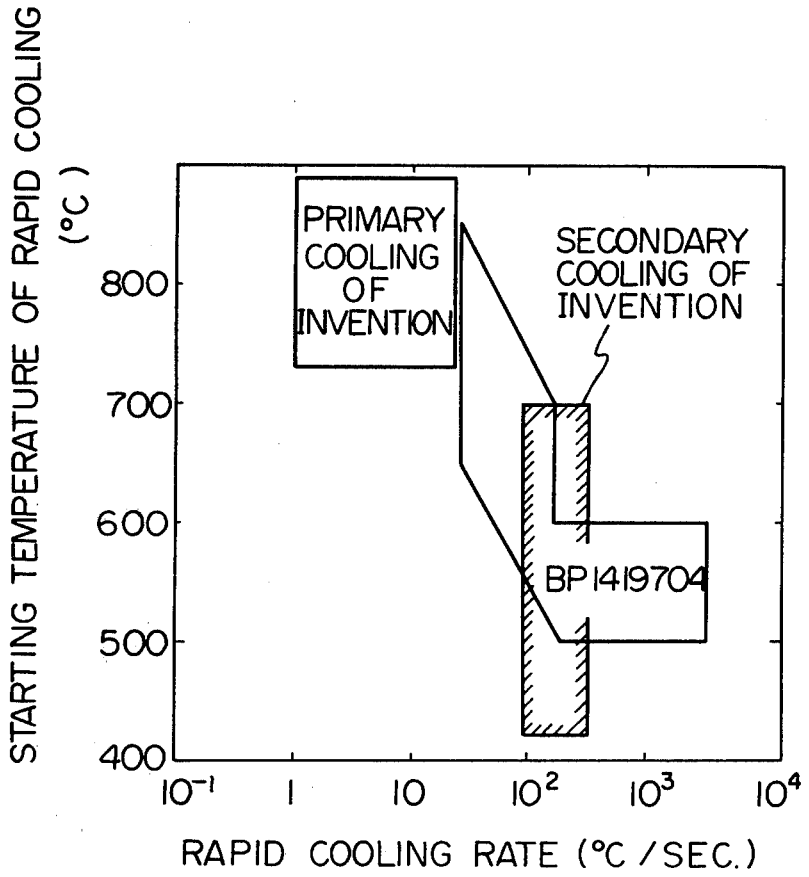

FIG. 4 is a graph illustrating the relationship of the methods of the present invention and B. Pat. No. 1,419,704 regarding the rapid cooling rate and the starting temperature of rapid cooling.

Figure 5:
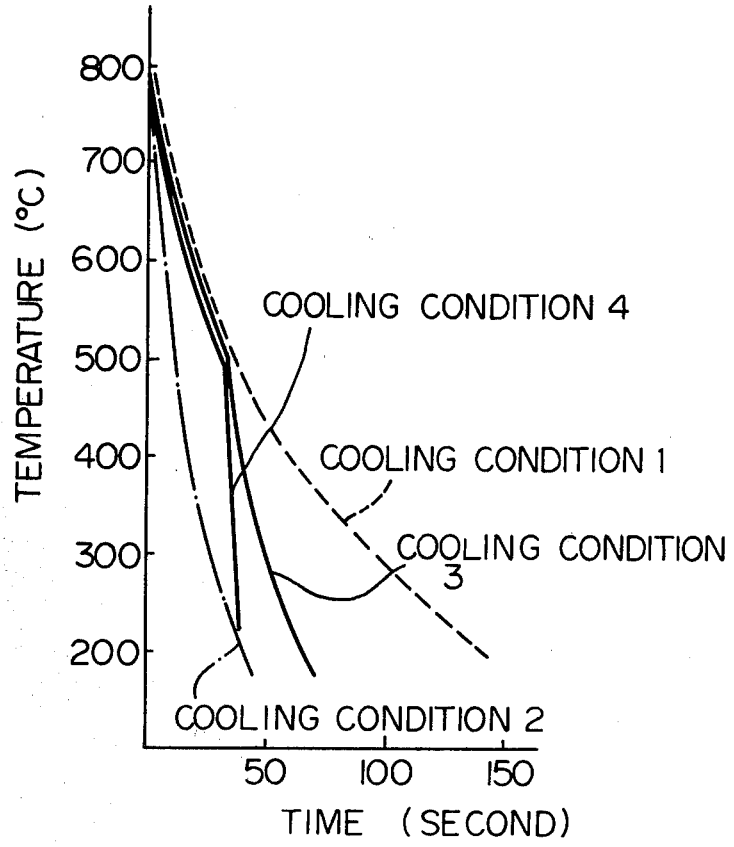

FIG. 5 is a graph illustrating the cooling conditions of steel A (cold-rolled steel sheet) after the continuous annealing.

Figure 6:
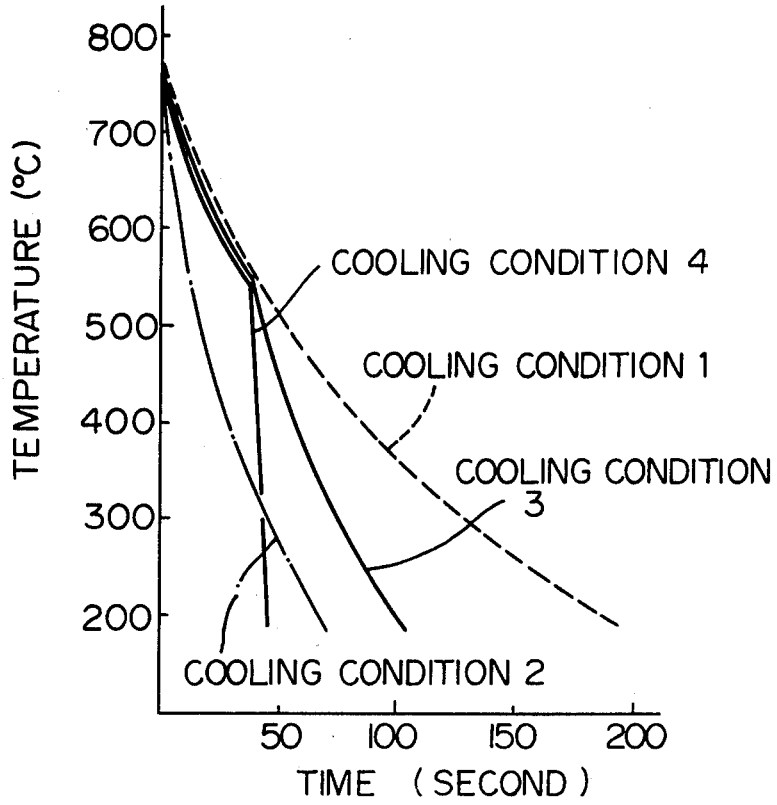

FIG. 6 is a graph illustrating the cooling conditions of steel B (hot-rolled steel sheet).

The basic concept of the present invention is explained hereinafter in comparison with the prior arts.

The present invention and prior arts are related to a technique of obtaining a dual-phase steel sheet, wherein the cold-rolled or hot-rolled steel sheet is firstly heated to the alpha-gamma temperature range, so as to partition the steel structure into the austenite phase and ferrite phase, and the steel sheet is then rapidly cooled so as to obtain the dual phase. In such steel, carbon and manganese are indispensable components and are contained in an amount specified from the properties required for the dual phase steel, while silicon and phosphorus are optional components. It has been believed according to the prior arts that as the cooling rate in the cooling stage following the heating in the alpha-gamma temperature range increases, the martensitic transformation of the austenite phase is more satisfactorily attained and thus a better dual-phase steel can be obtained. Accordingly, it has been a common practice to apply a cooling rate as large as possible within the limit of the maximum allowable cooling rate in a given production plant, provided there is no deterioration of the shape and ductility of steel sheet. The prior arts have not paid attention to whether or not the material properties of the dual-phase steel are influenced by the cooling pattern after the continuous annealing.

Figure 1:
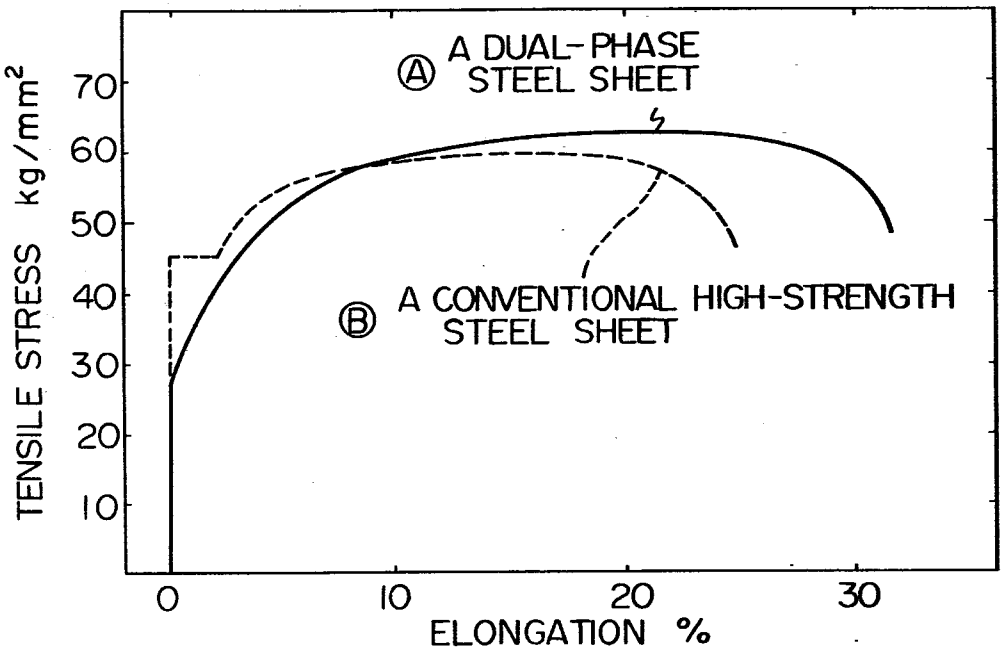
FIG. 1 is a graph of tensile stress versus elongation of a conventional high-strength steel sheet and a dual-phase steel sheet.
Figure 2:
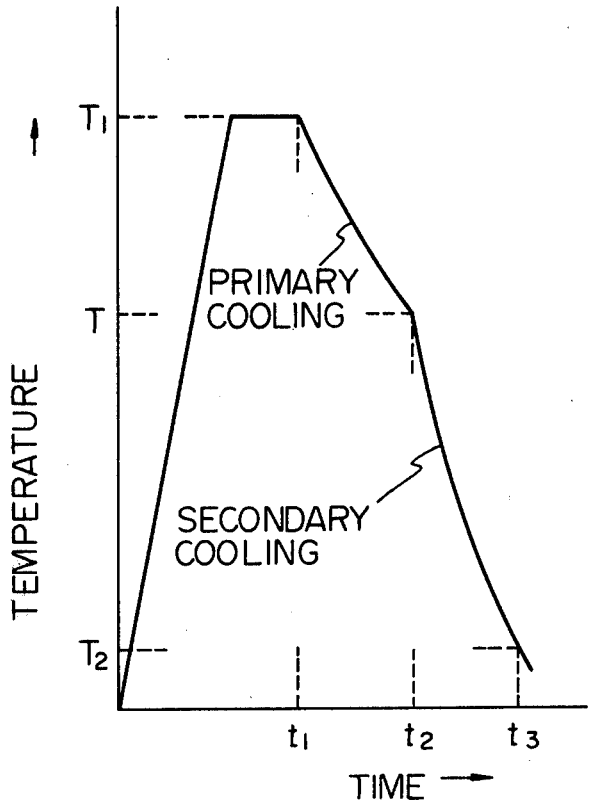
FIG. 2 illustrates a continuous annealing heat-cycle of the present invention.

Referring to FIG. 2, a continuous-annealing heat cycle of the present invention is illustrated. In FIG. 2, the temperature "$T_1$" is the annealing temperature in the alpha-gamma temperature range, the temperature "T" is an intermediate temperature between the primary and secondary cooling stages and the temperature "$T_2$" is a temperature not higher than 200° C. As apparent from FIG. 2, the cooling from $T_1$ to T is carried out at a relatively slow rate, and the cooling below T down to $T_2$ is carried out at a relatively rapid rate. The temperature $T_2$ is not higher than 200° C., so as to form sufficiently the rapidly-cooled transformed phase for the dual-phase steel. The cooling technique of the present invention is therefore different from the prior art technique with the monotonous cooling rate over the entire cooling stage. The present inventors have discovered that such material properties, as yield ratio, tensile strength and ductility, of the steel sheet produced by the method of the present invention are superior to those of the prior art technique.

In accordance with the present invention, there is provided a method for producing a dual-phase steel sheet mainly composed of a ferrite phase and an at least one rapidly-cooled transformed phase selected from the group consisting of a martensite phase, a bainite phase and a retained austenite phase, and having a tensile strength not lower than 40 kg/mm$^2$, excellent formability and high artificial-aging hardenability after forming. The method comprises, according to the characteristic of the invention, the steps of:

hot rolling a steel containing from 0.01 to 0.12% carbon, and from 0.7 to 1.7% manganese, followed by coiling;

continuously annealing the steel sheet, which has undergone the hot rolling, and has undergone further cold rolling if necessary, at an annealing temperature in the range of from 730° to 900° C., and;

cooling from the annealing temperature to a temperature not higher than 200° C. at an average cooling rate ($R_1$) in the range of 1° C./second$<R_1<$30° C./second over the primary cooling stage from the annealing temperature down to an intermediate temperature (T) in the range of 420° C.$<T<$700° C., and at an average cooling rate ($R_2$) in the range of 100° C./second$<R_2<$300° C./second over the secondary cooling stage from the intermediate temperature (T) down to the temperature not higher than 200° C.

The present invention is explained more in detail in comparison with the continuous annealing method of a cold rolled sheet of B. Pat. No. 1,419,704 which disclose the method similar to the method of the present invention at a glance. The technique of B. Pat. No. 1,419,704 is related to the continuous annealing of steel sheets for a general forming and aims to enhances the the press-formability and the resistance against aging which occurs at normal temperature. The technique of B. Pat. No. 1,419,704 involves the concept that, due to combination of continuous annealing followed by rapid cooling at a predetermined starting temperature with the overaging re-heat treatment after the continuous annealing, the supersaturated solid-solution carbon in the ferrite phase is caused to precipitate in the ferrite phase in such a manner as to desirably adjust the precipitation state for the forming of a steel sheet. The steel composition of B. Pat. No. 1,419,704 is not specified in the claims of the patent but is understood from the examples of the British patent to correspond to that of soft steels such as an aluminium-killed steel, a rimmed steel and a capped steel, namely the steel containing as the basic components approximately 0.05% carbon and 0.3% manganese. Since the hardenability of the austenite phase of the steel composition of the British patent is low, the main concern of the British patent is directed to processing the solid-solution carbon in the ferrite grains. Contrary to this, the main concern of the present invention is to produce, not a steel sheet for general forming, but a high-strength dual-phase steel sheet for press-forming. Namely, the present invention involves the basic concept that the austenite ($\gamma$) phase formed at the alpha-gamma temperature range must be sufficiently converted into the rapidly cooled transformed phase so as to provide the steel sheet with the structure of dual phase having properties desirable for the press forming. Thus, the steel composition must contain at least 0.7% manganese so as to ensure the hardenability of the austenite.

The differences between the present invention and B. Pat. No. 1,419,704 will be readily apparent from the statements of the overaging re-heat treatment in the British patent. Namely, in the British patent, the overaging re-heat treatment carried out at a temperature of from 300° to 500° C. over a period of 30 seconds or longer is deemed to be indispensable for controlling the carbide precipitation in ferrite phase. Referring to FIG. 3, a continuous-annealing heat-cycle of B. Pat. No. 2,419,704 is illustrated. In FIG. 3, $T_1'$ indicates the maximum heating temperature in the recrystallization temperature of a soft-steel strip to 850° C., and $T_2'$ indicates the starting temperature of rapid cooling. The time period from $t_1'$ to $t_2'$ may be a holding stage or a slow cooling stage and, allegedly, the dissolving of carbide and the solutionizing of carbon in the ferrite matrix are achieved in this time period. The subsequent rapid cooling from the temperature $T_2'$, allegedly, maintains a large amount of carbon in solid solution in the ferrite matrix, which is effective for the carbide precipitation in the next stage (temperature $T_4' \rightarrow T_5'$, time $t_4' \rightarrow t_5'$). The rapid cooling from $T_2'$ to $T_3'$ realizes, therefore, the maintenance of solid-solution carbon which later causes an effective precipitation of carbide in the overaging re-heat treatment stage over the period from $t_4'$ to $t_5'$ at a temperature from $T_4'$ to $T_5'$.

In the continuous-annealing heat cycle of the present invention shown in FIG. 2, the steel structure is partitioned at the temperature $T_1$ into the austenite ($\gamma$) phase and the ferrite phase ($\alpha$), the latter which contains some amount of carbon in solution. By the primary-cooling rate, i.e. $(T_1-T)/(t_2-t_1)$, the solid-solution carbon in the ferrite phase is concentrated into the untransformed austenite phase so as to stabilize the austenite. If the intermediate temperature (T) is higher than 700° C., this process of the concentration of carbon in the austenite phase is only insufficiently advanced. On the other hand, when the intermediate temperature (T) is lower than 420° C., the austenite phase is undesirably transformed into a fine pearlite phase. Too high a primary-cooling rate ($R_1$) causes the suppression of the diffusion of carbon from the alpha to gamma phases. The primary cooling having the purpose of mainly promoting the carbon diffusion should, therefore, be carried out at a properly low rate. However, if the primary-cooling rate ($R_1$) is too low, the pearlite transformation of the gamma phase takes place at a relatively high temperature, thus minimizing the fraction of gamma phase which can be converted to the rapidly-cooled transformed phase in the final product. The maximum and minimum primary-cooling rates ($R_1$) should therefore be set, so that $R_1$ is not greater than 30° C./second but is not smaller than 1° C./second (1° C./second $< R_1 <$ 30° C./second). However, as apparent from Table 5, the range of 10° C./second $< R_1 <$ 30° C./second is preferred for enhancing the artificial-hardenability after forming.

Subsequent to the primary cooling at a rate of $R_1$, the secondary cooling is performed at a cooling rate of $R_2$, thereby rapidly cooling the gamma phase still retained at the intermediate temperature T down to the temperature $T_2$ and changing the gamma phase to the rapidly-cooled transformed phase. The low yield-ratio inherent in the dual-phase steel is believed to result from elastic strains and mobile dislocations introduced into the ferrite matrix due to a martensitic transformation of the austenite phase. It is, therefore, necessary to change the gamma phase into the rapidly-cooled transformed phase. The temperature $T_2$ should be well below the Ms (martensite start temperature) point to ensure the formation of the rapidly-cooled transformed phase, and is 200° C. The secondary cooling having the purpose of mainly forming the rapidly-cooled transformed phase, should therefore be carried out at a high rate. When the secondary-cooling rate ($R_2$) is too low to form the rapidly-cooled transformed phase, the fine pearlite is formed. When the secondary-cooling rate ($R_2$) is excessively high, the solid-solution carbon in the ferrite phase, maintained at the intermediate temperature T, is not expelled from the ferrite phase, thus deteriorates the ductility of the final product. Besides, the sheet shape is distorted due to thermal stress. Considering such disadvantages due to a too high secondary-cooling rate, a low secondary-cooling rate ($R_2$) of not more than 100° C./second recited in U.S. Ser. No. 48,546 (U.S. Pat. No. 4,285,741) is advantageous from the viewpoint of ductility and the sheet-shape, so far as the rapidly-cooled transformed phase is formed. However, in this case, the solid-solution carbon in the ferrite phase of the final product is too low, so that the artificial-aging hardenability after forming, which is one of the requisite properties, becomes very inferior. The artificial-aging hardenability is caused by the fact that, at the aging stage, carbon atoms diffuse to the dislocations which have been developed in the ferrite phase by the preceded forming, and make the dislocations immobile. Accordingly, a certain quantity of solid-solution carbon in the ferrite phase is necessary for an appreciable artificial-aging hardenability after forming. Thus, in order to assure a high artificial-aging hardenability after working, the secondary-cooling rate ($R_2$) should be rather high. However, on the other hand, the ductility should not be deteriorated extremely due to a high secondary-cooling rate ($R_2$). The maximum and minimum secondary-cooling rates ($R_2$) are therefore set so that $R_2$ is not greater than 300° C./second but not smaller than 100° C./second (100° C./second $< R_1 <$ 300° C./second).

In the method for producing a dual-phase steel sheet according to the present invention, the higher-temperature region and the lower-temperature region of the cooling stage should have individual functions respectively. That is, mainly the carbon concentration into the gamma phase and additionally the maintenance of such solid-solution quantity of carbon in the alpha phase as required for the artificial-aging hardenability after forming should be achieved in the higher-temperature region, while the formation of the rapidly-cooled transformed phase and the maintenance of the solid-solution carbon quantity mentioned above should be ensured in the lower-temperature region.

Referring to FIG. 4, the relationships between the starting temperature of rapid cooling and the cooling rate of the present invention and those of B. Pat. No. 1,419,704 are apparent.

The steel, which is processed according to the production steps of the present invention, must contain at least 0.01% carbon and at least 0.7% manganese. However, when the carbon and manganese exceed 0.12% and 1.7%, respectively, the carbon and manganese deteriorate the weldability. Silicon strengthens steel, but a large amount of silicon impairs the scale-peeling property and thus causes a degraded surface quality of a steel sheet. The maximum silicon content is 1.2%.

The steel, which is processed by the production steps of the present invention, may be melted either using an open-hearth furnace, a converter or an electric furnace. When a relatively low carbon-level is desired, a vacuum-degassing may be applied to the steel melt. A steel grade may be rimmed steel, capped steel, semi-killed steel or killed steel. An aluminum-killed steel with an aluminum content of from 0.01 to 0.1% is, however, preferable. The steel may contain not less than approximately 0.05% of at least one element selected from the group consisting of rare-earth metal, zirconium (Zr) and calcium, which controls the morphology of non-metallic inclusions composed of sulfide and thus enhance the bending formability.

The casting of steel melt may be carried out by a conventional ingot-making or a continuous casting.

The cast steel is then subjected to a rough hot rolling and finaly a hot rolling. The hot rolled strip may further be subjected to the cold rolling prior to the continuous annealing. Since the condition of these rollings are well-known in the steel industry, it is not described herein for the sake of brevity. Continuous annealing temperatures in this invention, represented as $T_1$ in FIG. 2, are in the alpha-gamma range, namely from 730° C. to 900° C. (730° C. $<T_1<$ 900° C.).

The method of the present invention may be utilized for the production of a dual-phase steel with a hot-dip metal coating. For example, in the case of the zinc hot dipping, a steel sheet is cooled from $T_1$ to T by a suitable method, e.g. such as gas jet application, at a rate specified by $R_1$, then it is dipped through a molten zinc bath maintained at about the temperature T, for a few seconds. Since a molten zinc coating bath is usually kept at 460°~500° C., the temperature fits into the specified range of T. After dipping, the sheet is cooled from T to a temperature lower than 200° C. at a rate specified by $R_2$. In addition, the steel composition processed according to the present invention does not contain a large amount of silicon detrimental to the zinc plating, or the steel composition may not contain silicon at all. Therefore, the steel composition is advantageous for zinc coating.

The method of the present invention and the reasons for limitation of the process parameter, such as T, $R_1$ and $R_2$, are explained hereinafter by way of examples.

EXAMPLE 1

An aluminum (Al)-killed steel (Steel A) having the composition given in Table 1 was hot rolled in a normal manner (finishing temperature 900° C.) and coiled at 500° C., and the so-obtained 2.7 mm thick hot rolled strip was cold rolled at a reduction of 70% to produce the 0.8 mm thick cold rolled sheets. The cold rolled sheets were heated to the alpha-gamma temperature range and cooled under the containuous annealing and cooling conditions given in Table 2. To determine the artificial-aging hardenability after forming, the continuously annealed steel sheets were subjected to the measurement of 3% plastic flow strength at room temperature under the application of 3% tensile strain. After unloading, the 3% strained sheets were heated at 180° C. for 30 minutes, and then the yield strength after such treatments was measured at room temperature. The artificial-aging hardenability after forming was determined in terms of an increment of the yield strength as compared with the 3% plastic flow strength. The aritificial-aging hardenability after forming in all examples was determined by the procedure described above.

TABLE 1

| Designation of Steel | Composition of Steel A C | Si | Mn | P | S | Al |
|---|---|---|---|---|---|---|
| A | 0.052 | 0.01 | 1.48 | 0.010 | 0.007 | 0.023 |

TABLE 2

Continuous-annealing Condition and Properties of Steel A

| Holding Condition at Continuous Annealing | | Cooling Condition | YS kg/mm² | TS kg/mm² | El % | YS/TS | Artificial-aging Hardenability after Forming kg/mm² |
|---|---|---|---|---|---|---|---|
| 800° C. for 1 minute | 1 | 800° C. → 200° C. Average Cooling Rate 4.3° C./second | 28.0 | 39.5 | 36.0 | 0.71 | 3.0 |
| 800° C. for 1 minute | 2 | 800° C. → 200° C. Average Cooling Rate 15° C./second | 24.2 | 41.0 | 32.8 | 0.59 | 4.8 |
| 800° C. for 1 minute | 3 | $R_1$ from 800 to 500° C. = 9° C./second $R_2$ from 500 to 200° C. = 10° C./second | 18.5 | 43.5 | 35.7 | 0.42 | 3.2 |
| 800° C. for 1 minute | 4 | $R_1$ from 800 to 500° C. = 9° C./second $R_2$ from 500 to 200° C. = 150° C./second | 22.0 | 45.9 | 27.5 | 0.48 | 6.4 |

(YS: Yield strength, TS: Tensile strength, El: Elongation)

The cooling conditions in Table 2 are graphically illustrated in FIG. 5. The cooling conditions were adjusted by controlling the cooling power by air-jet stream or air-jet stream with mixed water droplets. As is apparent from Table 2, the cooling condition ③ is the best in the light of high ductility and low yield ratio. However, the cooling condition ④ with a high secondary-cooling rate is desirable in the light of high tensile strength and high artificial-aging hardenability after forming.

EXAMPLE 2

An aluminum (Al)-silicon(Si)-killed steel (Steel B) having the composition given in Table 3 was hot rolled in a normal manner (finishing temperature 880° C.) and coiled at 620° C. The thus rolled 1.6 mm thick hot rolled strip was heated to the alpha-gamma temperature range and cooled under the continuous annealing and cooling conditions given in Table 4.

The cooling conditions in Table 4 are graphically illustrated in FIG. 6.

As is apparent from Table 4, the cooling condition ④ with high secondary-cooling rate is desirable in the light of high tensile strength and high artificial-aging hardenability after forming.

TABLE 3

| Designation of Steel | Composition of Steel B C | Si | Mn | P | S | Al |
|---|---|---|---|---|---|---|
| B | 0.091 | 0.44 | 1.54 | 0.012 | 0.005 | 0.026 |

TABLE 4

Continuous-annealing Condition and Properties of Steel B

| Holding Condition at Continuous Annealing | | Cooling Condition | YS kg/mm² | TS kg/mm² | El % | YS/TS | Artificial-aging Hardenability after Forming kg/mm² |
|---|---|---|---|---|---|---|---|
| 780° C. for 2 minutes | 1 | 780° C. → 200° C. Average Cooling Rate 3° C./second | 38.9 | 52.1 | 32.0 | 0.75 | 2.5 |
| 780° C. for 2 minutes | 2 | 780° C. → 200° C. Average Cooling Rate 8.5° C./second | 35.3 | 53.0 | 31.1 | 0.67 | 4.4 |
| 780° C. for 2 minutes | 3 | $R_1$ from 780 to 550° C. = 4.8° C./second $R_2$ from 550 to 200° C. = 6° C./second | 25.7 | 57.2 | 33.5 | 0.45 | 3.0 |
| 780° C. for 2 minutes | 4 | $R_1$ from 780 to 550° C. = 4.8° C./second $R_2$ from 550 to 200° C. = 110° C./second | 28.0 | 62.2 | 28.5 | 0.45 | 6.2 |

EXAMPLE 3

The cold-rolled sheets prepared in Example 1 were heated to the alpha-gamma temperature range followed by cooling at various primary-cooling rates $R_1$ and secondary-cooling rates $R_2$ given in Table 5. The intermediate temperature T was constant at 520° C. The cooling rates were adjusted by controlling the cooling power by air-jet stream or air-jet stream with mixed water droplets. As is apparent from Table 5, when the primary-cooling rate $R_1$ is 0.5° C./second, a low yield ratio such as one smaller than 0.6 cannot be obtained at any level of the secondary-cooling rate $R_2$. On the other hand, when the primary-cooling rate $R_1$ amounts to 40° C./second, a low yield ratio can be obtained but the elongation is extremly deteriorated. The primary-cooling rate of 1° C./second $< R_1 <$ 30° C. is suitable for the low yield ratio and high ductility. With regard to the artificial-aging hardenability after forming, such hardenability of approximately 7 kg/mm² at the maximum is obtained at the primary-cooling rate $R_1$ of less than 10° C./second, and such hardenability of 8 kg/mm² at the maximum can be obtained at the primary-cooling rate of more than 10° C./second. The primary-cooling rate is, therefore, preferably greater than 10° C./second but not greater than 30° C./second (10° C./second $< R_1 <$ 30° C./second).

TABLE 5

Cooling Rates in Continuous Annealing versus Properties of Steel A

| primary-cooling Rate from 800° C. to 520° C. ($R_1$ °C./second) | Secondary-cooling Rate from 520° C. to 200° C. ($R_2$ °C./second) | TS kg/mm² | YS/TS | El % | Artificial-aging-Hardenability after Forming kg/mm² |
|---|---|---|---|---|---|
| 0.5 | 85 | 41.9 | 0.70 | 34.8 | 3.0 |
| | 150 | 42.8 | 0.71 | 28.5 | 3.9 |
| 9 | 5 | 39.6 | 0.68 | 35.5 | 3.1 |
| | 10 | 43.4 | 0.43 | 35.6 | 3.2 |
| | 85 | 44.5 | 0.46 | 33.8 | 4.1 |
| | 150 | 46.0 | 0.49 | 27.5 | 6.4 |
| | 280 | 47.2 | 0.48 | 27.0 | 6.7 |
| | 400 | 47.3 | 0.45 | 22.8 | 7.0 |
| 15 | 10 | 41.1 | 0.61 | 33.0 | 3.0 |
| | 30 | 44.0 | 0.47 | 32.8 | 4.7 |
| | 85 | 45.5 | 0.48 | 32.5 | 4.9 |
| | 150 | 47.6 | 0.46 | 24.9 | 8.1 |
| 40 | 10 | 46.5 | 0.58 | 26.5 | 3.8 |
| | 85 | 48.3 | 0.56 | 22.5 | 4.9 |

TABLE 5-continued

Cooling Rates in Continuous Annealing versus Properties of Steel A

| primary-cooling Rate from 800° C. to 520° C. ($R_1$ °C./second) | Secondary-cooling Rate from 520° C. to 200° C. ($R_2$ °C./second) | TS kg/mm² | YS/TS | El % | Artificial-aging-Hardenability after Forming kg/mm² |
|---|---|---|---|---|---|
| | 150 | 48.5 | 0.55 | 22.0 | 8.0 |

Remarks: Holding condition in continuous annealing was 800° C. for 1 minute and the intermediate temperature in the cooling was 520° C.

EXAMPLE 4

The cold rolled sheets prepared in Example 1 were heated to the alpha-gamma temperature range followed by cooling at various primary-cooling rates $R_1$, secondary-cooling rates $R_2$ and the intermediate temperature T given in Table 6.

As is apparent from Table 6, at the intermediate temperature T of 400° C. or lower the low yield ratio cannot be obtained, while at the intermediate temperature T of higher than 700° C. the elongation is deteriorated. The intermediate temperature should be from 420° to 700° C. (420° C. $< T <$ 700° C.).

TABLE 6

Intermediate-temperature levels versus Yield Ratio and Elongation

| Primary-cooling Rate $R_1$ °C./sec. | Intermediate Temperature T °C. | Secondary-cooling Rate $R_2$ °C./sec. | YS/TS | El % |
|---|---|---|---|---|
| 8 | 360 | 150 | 0.72 | 32.8 |
| 8 | 400 | 280 | 0.71 | 31.3 |
| 10 | 450 | 280 | 0.46 | 30.2 |
| 9 | 500 | 250 | 0.42 | 27.0 |
| 9 | 520 | 250 | 0.48 | 27.0 |
| 7 | 600 | 150 | 0.48 | 27.1 |
| 4 | 680 | 120 | 0.52 | 26.8 |
| 8 | 750 | 110 | 0.54 | 23.5 |

EXAMPLE 5

Steel sheets having various carbon, silicon and manganese contents were continuously annealed under the condition given in Table 7. These contents were varied so that the composition limitation for obtaining the low yield ratio could be considered.

As is apparent from Table 7, in Steel C with 0.005% C and 1.5% Mn the low yield ratio cannot be achieved. Taking this fact, and the results of Steels D through H, into consideration, the inventors consider that at least 0.01% C and at least 0.7% Mn are necessary for the dual-phase structure and thus the low yield ratio.

TABLE 7

Strength and Ductility of 0.8mm thick Steel Sheets

| Steels | Component (weight %) C | Si | Mn | Hot-rolling Condition: Finishing Temperature °C. | Coiling Temperature °C. | Continuous-annealing Condition: Holding | $R_1$ °C./second | T °C. | $R_2$ °C./second | TS kg/mm² | YS/TS | El % |
|---|---|---|---|---|---|---|---|---|---|---|---|---|
| C | 0.005 | 0.02 | 1.50 | 900 | 700 | 800° C. for 1 minute | 8 | 550 | 100 | 33.0 | 0.67 | 42.5 |
| D | 0.02 | 0.90 | 1.68 | 890 | 720 | 780° C. for 1 minute | 8 | 450 | 150 | 41.2 | 0.40 | 37.5 |
| E | 0.09 | 0.32 | 0.54 | 900 | 700 | 800° C. for 1 minute | 9 | 550 | 120 | 37.2 | 0.72 | 43.0 |
| F | 0.08 | 0.45 | 0.90 | 910 | 740 | 850° C. for 2 minutes | 6 | 580 | 110 | 43.5 | 0.59 | 36.1 |
| G | 0.10 | 1.15 | 1.30 | 880 | 690 | 820° C. for 3 minutes | 4 | 520 | 120 | 60.8 | 0.52 | 30.2 |
| H | 0.09 | 0.02 | 1.70 | 870 | 620 | 770° C. for 2 minutes | 10 | 500 | 120 | 67.9 | 0.41 | 26.8 |

EXAMPLE 6

Table 8 shows mechanical properties of steels with or without such sulfide-shape controlling elements as Ca or rare-earth metals. The basic composition of the steels and continuous annealing thermal cycles are within the scope of this invention. Steels K and L are of hot-rolled gauges, and M and N are of cold-rolled gauges. As clearly seen from Table 8, such sulfide-shape controlling elements help to improve ductility parameters like hole-expansion ratio and Erichsen value.

TABLE 8

Mechanical Properties of Continuously Annealed Steel Sheets with or without Such Elements as Ca or Rare-Earth Metal Additions, Indicating Improvements in Hole-Expansion Ratio and Erichsen Value.

| Steel | Composition (wt %) C | Si | Mn | S | Ca | REM (Ce + La) | Hot Rolling Condition: Finishing Temp. °C. | Coiling Temp. °C. | Continuous Annealing and Cooling Condition: Soaking | $R_1$ °C./s. | T °C. | $R_2$ °C./s. |
|---|---|---|---|---|---|---|---|---|---|---|---|---|
| k(1) | 0.070 | 0.70 | 1.40 | 0.013 | n.a.(3) | n.a. | 880 | 600 | 800° C. for 2 min. | 15 | 490 | 120 |
| L(1) | 0.069 | 0.71 | 1.41 | 0.007(4) | 0.0056(4) | n.a. | 880 | 600 | 800° C. for 2 min. | 15 | 490 | 120 |
| M(2) | 0.081 | 0.02 | 1.20 | 0.008 | n.a. | n.a. | 890 | 650 | 780° C. for 40 sec. | 20 | 600 | 200 |
| N(2) | 0.080 | 0.02 | 1.22 | 0.008 | n.a. | 0.022(5) | 890 | 650 | 780° C. for 40 sec. | 20 | 600 | 200 |

| Steel | TS kg/mm² | YS/TS | El % | Artificial Age-hardenability after forming kg/mm² | Hole-Expansion ratio d/do | Erichsen Value mm |
|---|---|---|---|---|---|---|
| k(1) | 61.5 | 0.51 | 30.2 | 7.2 | 1.6 | — |
| L(1) | 61.9 | 0.49 | 31.8 | 7.2 | 1.9 | — |
| M(2) | 62.2 | 0.52 | 28.4 | 8.4 | — | 10.7 |
| N(2) | 62.5 | 0.51 | 28.7 | 8.6 | — | 11.2 |

(1)hot rolled gauge, 1.6 mm thick.
(2)cold rolled with a 75% reduction, 1.00 mm thick.
(3)n.a.: not added.
(4)In ladle analysis, S: 0.012%, Ca was originally added 0.018%.
(5)REM (Ce + La) was originally added 0.032%.

We claim:

1. A method for producing a dual-phase steel sheet mainly composed of a ferrite phase and at least one rapidly-cooled transformed phase selected from the group consisting of a martensite phase, a bainite phase and a retained austenite phase, and having a tensile strength not lower than 40 kg/mm², excellent formability and high artificial-aging hardenability after forming, comprising the steps of:

hot rolling a steel containing from 0.01 to 0.12% carbon and from 0.7 to 1.7% manganese, followed by coiling;

continuously annealing the steel sheet, which has undergone the hot rolling, at an annealing temperature in the range of from 730° to 900° C., and;

cooling in two successive stages from the annealing temperature to a temperature lower than 200° C. at an average primary cooling rate ($R_1$) in the range of 1° C./second$<R_1<$30° C./second over a primary cooling stage from said annealing temperature down to an intermediate temperature (T) in the range of 420$<$T$<$700° C., and at an average secondary cooling rate ($R_2$) in the range of 100° C./second $< R_2 <$ 300° C./second over a secondary cooling stage from the intermediate temperature (T) down to a temperature not higher than 200° C., said secondary average cooling rate ($R_2$) being high enough within its said range so as to provide the cooled steel sheet with said excellent formability and high artificial-hardenability after forming.

2. A method according to claim 1, wherein the hot rolled sheet is further subjected to a cold rolling prior to said continuously annealing step.

3. A method according to claim 1 or 2, wherein said primary-cooling rate ($R_1$) is in the range of 10° C./second $< R_1 <$ 30° C./second.

4. A method according to claim 3, wherein said steel further contains not more than 1.2% silicon.

5. A method according to claim 4, wherein said steel further contains from 0.01 to 0.10% aluminum.

6. A method according to claim 4, wherein said steel further contains not more than 0.5% of at least one element selected from the group consisting of rare earth metals, calcium and zirconium.

7. A method according to claim 1 or claim 2, wherein said steel sheet goes through a molten metal bath kept at an intermediate temperature T (420° C. $< T <$ 700° C.) after cooling from the annealing temperature to T at an average rate specified as $R_1$ (1° C./second $< R_1 <$ 30° C./second), then is cooled from T to a temperature not higher than 200° C. at an average rate specified as $R_2$ (100° C./second $< R_2 <$ 300° C./second).

* * * * *

UNITED STATES PATENT AND TRADEMARK OFFICE

CERTIFICATE OF CORRECTION

PATENT NO. : 4,394,186

DATED : July 19, 1983

INVENTOR(S) : Furukawa, et al.

It is certified that error appears in the above—identified patent and that said Letters Patent is hereby corrected as shown below:

In the abstract, line 12; change "comprise" to --comprises--

Col. 4, line 10; change "1°C./second $< R_1 <$ 30°C./second" to --1°C./second $\leq R_1 \leq$ 30°C./second"

Col. 4, line 13; change "420°C. $< T <$ 700°C." to --420°C. $\leq T \leq$ 700°C.--

Col. 4, line 14; change "100°C./second $< R_2 <$ 300°" to --100°C./second $\leq R_2 \leq$ 300°--

Col. 4, line 20; change "disclose" to --discloses--

Col. 4, line 24; change "enhances" to --enhance--

UNITED STATES PATENT AND TRADEMARK OFFICE

CERTIFICATE OF CORRECTION

PATENT NO. : 4,394,186

DATED : July 19, 1983

INVENTOR(S) : Furukawa, et al.

It is certified that error appears in the above—identified patent and that said Letters Patent is hereby corrected as shown below:

Col. 5, lines 41, 42; change "(1°C./second $< R_1 <$ 30° C./second)" to --(1°C./second $\leq R_1 \leq$ 30°C./second)--

Col. 5, line 43; change "10°C./second $< R_1 <$ 30°C./second" to --10°C./second $\leq R_1 \leq$ 30°C./second--

Col. 6, line 27; change "(100°C./second $< R_1 <$ 300° C./second)" to --(100°C./second $\leq R_1 \leq$ 300°C./second)--

Col. 7, line 4; change "finaly" to --finally--

Col. 7, line 11; change "(730°C. $< T_1 <$ 900°C.)" to --(730°C. $\leq T_1 \leq$ 900°C.)--

UNITED STATES PATENT AND TRADEMARK OFFICE

CERTIFICATE OF CORRECTION

PATENT NO. : 4,394,186

DATED : July 19, 1983

INVENTOR(S) : Furukawa, et al.

It is certified that error appears in the above—identified patent and that said Letters Patent is hereby corrected as shown below:

Col. 9, line 38; change "1°C./second $< R_1 <$ 30°C." to --1°C./second $\leq R_1 \leq$ 30°C. --.

Col. 9, lines 47, 48; change "(10°C./second $< R_1 <$ 30° C./second)" to --(10°C./second $\leq R_1 \leq$ 30°C./second)--

Col. 10, line 47; change "(420°C. $< T <$ 700°C.)" to --(420°C. $\leq T \leq$ 700°C.)--

Col. 12, line 35; change "1°C./second $< R_1 <$ 30°C./ second" to --1°C./second $\leq R_1 \leq$ 30°C./second--

Col. 13, line 2; change "C./second $< R_2 <$ 300°C./ second" to --C./second $\leq R_2 \leq$ 300°C./second--

UNITED STATES PATENT AND TRADEMARK OFFICE

CERTIFICATE OF CORRECTION

PATENT NO. : 4,394,186

DATED : July 19, 1983

INVENTOR(S) : Furukawa, et al.

It is certified that error appears in the above—identified patent and that said Letters Patent is hereby corrected as shown below:

Col. 13, line 14; change "C./second $< R_1 <$ 30°C./second" to --C./second $\leq R_1 \leq$ 30°C./second--

Col. 14, line 11; change "(420°C. $< T <$ 700°C.)" to --(420°C. $\leq T \leq$ 700°C.)--

Col. 14, line 13; change "(1°C./second $< R_1 <$ 30°" to --(1°C./second $\leq R_1 \leq$ 30°--

Col. 14, line 16; change "(100°C./second $< R_2 <$ 300° C./second)" to --(100°C./second $\leq R_2 \leq$ 300°C./second)--

Signed and Sealed this

*Seventeenth* Day of *January 1984*

[SEAL]

*Attest:*

GERALD J. MOSSINGHOFF

*Attesting Officer*

*Commissioner of Patents and Trademarks*